US010656570B2

(12) United States Patent
Tomine

(10) Patent No.: US 10,656,570 B2
(45) Date of Patent: May 19, 2020

(54) IMAGE FORMING APPARATUS OPERABLE IN COLOR AND MONOCHROMATIC MODES

(71) Applicant: CANON KABUSHIKI KAISHA, Tokyo (JP)

(72) Inventor: Jun Tomine, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/654,919

(22) Filed: Jul. 20, 2017

(65) Prior Publication Data

US 2018/0024475 A1 Jan. 25, 2018

(30) Foreign Application Priority Data

Jul. 21, 2016 (JP) ..... 2016-143421

(51) Int. Cl.

| | |
|---|---|
| ***G03G 15/00*** | (2006.01) |
| ***G03G 15/01*** | (2006.01) |
| ***G03G 15/16*** | (2006.01) |
| ***G03G 21/00*** | (2006.01) |

(52) U.S. Cl.

CPC ..... *G03G 15/1675* (2013.01); *G03G 15/0136* (2013.01); *G03G 15/161* (2013.01); *G03G 15/5025* (2013.01); *G03G 15/5029* (2013.01); *G03G 15/0121* (2013.01); *G03G 21/0011* (2013.01); *G03G 2215/00949* (2013.01); *G03G 2215/0132* (2013.01)

(58) Field of Classification Search

None

See application file for complete search history.

(56) References Cited

U.S. PATENT DOCUMENTS

| | | | | |
|---|---|---|---|---|
| 5,376,998 | A * | 12/1994 | Suzuki | G03G 15/0121 399/228 |
| 8,050,582 | B2 * | 11/2011 | Aiba | G03G 15/1605 399/297 |
| 2007/0110463 | A1 * | 5/2007 | Sako | G03G 15/5062 399/45 |
| 2009/0148202 | A1 * | 6/2009 | Aiba | G03G 15/161 399/303 |

(Continued)

FOREIGN PATENT DOCUMENTS

| | | | |
|---|---|---|---|
| JP | 2005-148126 | A | 6/2005 |
| JP | 2009-105827 | A | 5/2009 |
| JP | 2012-189797 | A | 10/2012 |

*Primary Examiner* — Victor Verbitsky

(74) *Attorney, Agent, or Firm* — Venable LLP

(57) ABSTRACT

An image forming apparatus includes a black image forming portion, a color image forming portion, an intermediary transfer member, a transfer portion, and an executing portion capable of executing an operation in a color mode in which a color image is formed using the color image forming portion and the black image forming portion and an operation in a monochromatic mode in which a monochromatic image is formed using only the black image forming portion. The executing portion is capable of forming the monochromatic image in the operation in the monochromatic mode under application of a voltage to the black developing device. The voltage is applied under a voltage condition such that a line width is broader than a line width under a voltage condition inputted to the black developing device when the operation in the color mode is executed.

12 Claims, 14 Drawing Sheets

(56) References Cited

U.S. PATENT DOCUMENTS

2012/0237236 A1* 9/2012 Nakade ..... G03G 15/065
399/55
2016/0291499 A1 10/2016 Shibuya

* cited by examiner (a)

(b)

(c)

(a)

(b)

IMAGE FORMING APPARATUS OPERABLE IN COLOR AND MONOCHROMATIC MODES

FIELD OF THE INVENTION AND RELATED ART

The present invention relates to an image forming apparatus, such as a copying machine, a facsimile machine or a printer of an electrophotographic type or an electrostatic recording type.

Conventionally, for example, in the image forming apparatus of the electrophotographic type, there is a tandem type in which toner images formed with different color toners on a plurality of photosensitive members as image bearing members are successively transferred superposedly onto an intermediary transfer member or a recording material carried on a recording material carrying member. The image forming apparatus of the tandem type has an advantage such that speed-up of the image forming apparatus is easy.

The image forming apparatus of the tandem type using the intermediary transfer member will be further described as an example. In the image forming apparatus of this type, the intermediary transfer member contacts the photosensitive members at primary transfer portions where the toner images are transferred from the photosensitive members onto the intermediary transfer member. For that reason, depending on friction and contact pressures, the photosensitive members and the intermediary transfer member are gradually abraded or are changed in surface characteristic in some instances. For that reason, for example, in an image forming apparatus capable of carrying out image formation by an operation in a full-color mode and an operation in a black (single color) mode, the intermediary transfer member is spaced, during the operation in the black mode, from the photosensitive member which is not in the image formation. As a result, a deterioration of the photosensitive members and the intermediary transfer member is suppressed, so that lifetimes of these members can be extended.

On the other hand, in the image forming apparatus of this type, there is a wide variety of print data to be processed, and there arises a problem such that a density of a character image and a line image (particularly a thin line image) is ensured while forming a high-quality color image. In order to solve this problem, Japanese Laid-Open Patent Application 2009-105827 has proposed an image forming apparatus including a thin line command detecting means for detecting a thin line command by a drawing instruction, a thin line color acquiring means for acquiring a color of a thin line, and a thin line width changing means for thickening a thickness (width) of the thin line.

However, in a constitution in which a process for thickening the thin line on the basis of object data or command data of the image, it becomes difficult to discriminate the character image itself and the line image itself, and therefore the density of the character image and the line image (particularly thin line image) cannot be sufficiently ensured in some cases.

For example, depending on a kind of documents, even when the image is the character image or the line image, in some instances, an attribute of the image is treated as an attribute, of decreasing image data, such as a graphic or image attribute, not a character or line attribute. In this case, when the image (data) is discriminated as the object image (data), this image is not discriminated as the character image or the line image, so that the thickening process as described above cannot be carried out.

SUMMARY OF THE INVENTION

A principal object of the present invention is to provide an image forming apparatus capable of acquiring a density of a character image or a line image of a black (monochromatic) image.

According to an aspect of the present invention, there is provided an image forming apparatus comprising: a black image forming portion including an image bearing member and a black developing device including a black toner; a color image forming portion configured to form an image with a yellow toner, a magenta toner and a cyan toner; an intermediary transfer member capable of carrying a toner image formed at the black image forming portion and a toner image formed at the color image forming portion; a transfer portion configured to transfer the toner image from the intermediary transfer member onto a recording material; and an executing portion capable of executing an operation in a color mode in which a color image is formed on the recording material by using the color image forming portion and the black image forming portion and an operation in a monochromatic mode in which a monochromatic image is formed on the recording material by using only the black image forming portion, wherein the executing portion is capable of forming the monochromatic image in the operation in the monochromatic mode under application of a voltage to the black developing device, the voltage being applied under a voltage condition such that a line width is broader than a line width under a voltage condition inputted to the black developing device when the operation in the color mode is executed.

Further features of the present invention will become apparent from the following description of exemplary embodiments with reference to the attached drawings.

DESCRIPTION OF EMBODIMENTS

An image forming apparatus according to the present invention will be described with reference to the drawings.

Embodiment 1

1. General Constitution and Operation of Image Forming Apparatus

Figure 1:
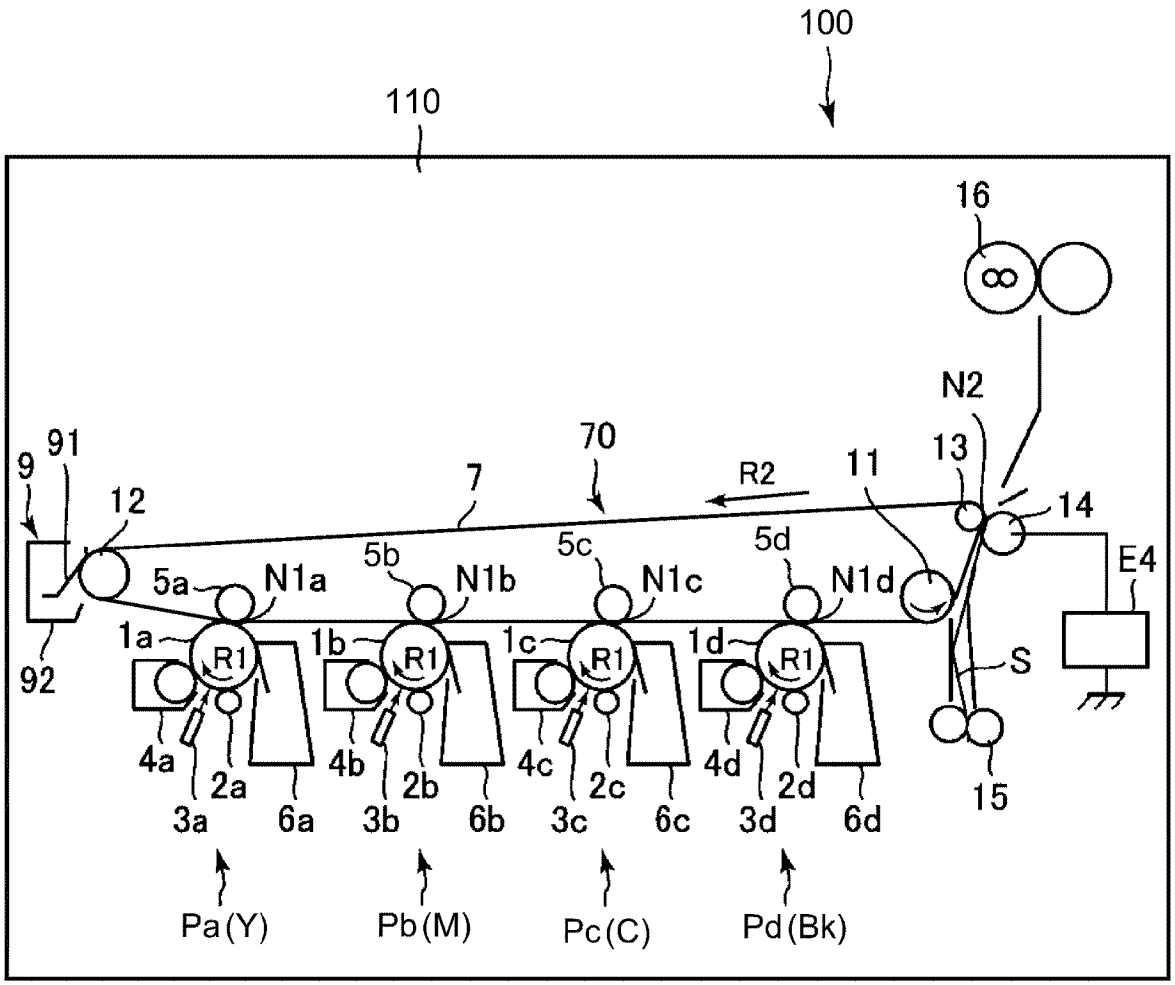
FIG. 1 is a schematic sectional view of an image forming apparatus.

FIG. 1 is a schematic sectional view of an image forming apparatus 100 in this embodiment according to the present invention.

Figure 2:
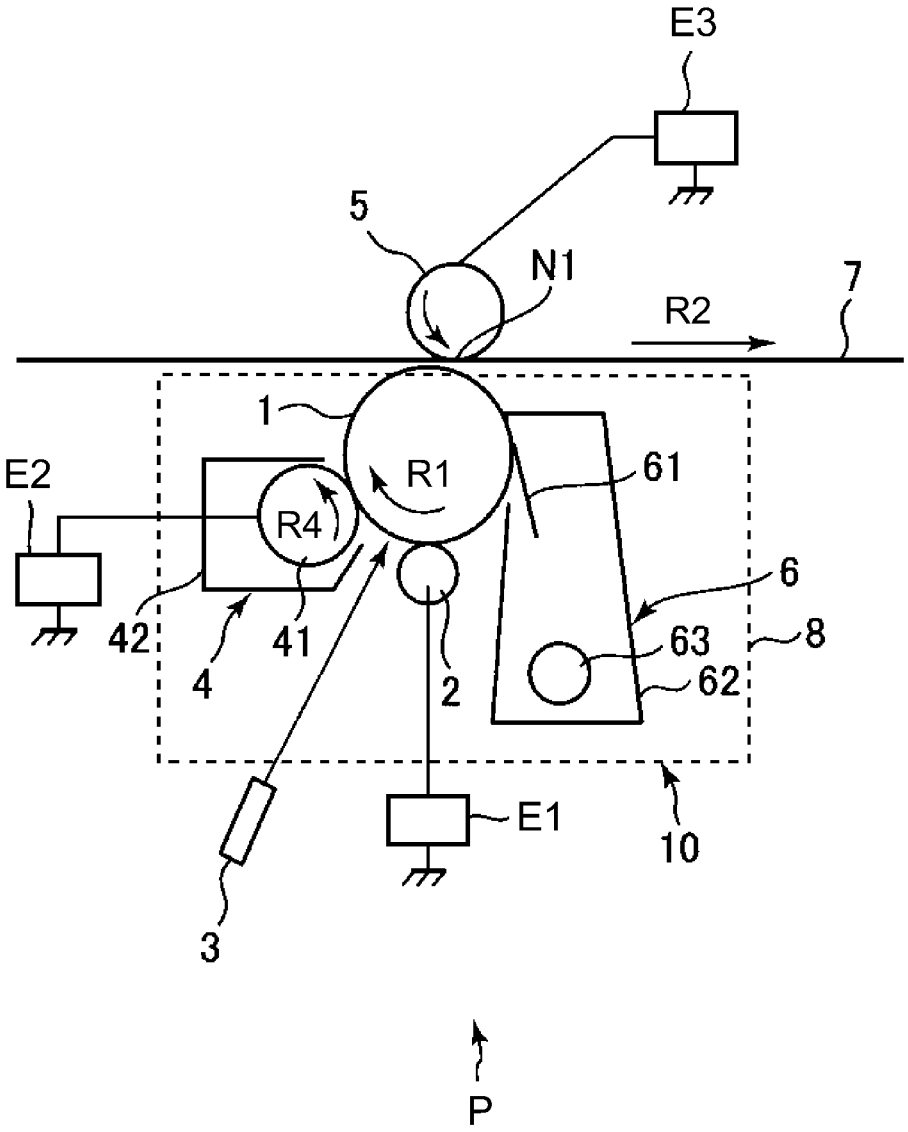
FIG. 2 is a schematic sectional view of an image forming portion.

The image forming apparatus 100 in this embodiment is a tandem-type (in-line type) color image forming apparatus employing an intermediary transfer type. The image forming apparatus 100 includes, as a plurality of image forming portions (stations), first to fourth image forming portions Pa, Pb, Pc and Pd for forming toner images of yellow (Y), magenta (M), cyan (C) and black (Bk), respectively. As regards elements having the same or corresponding function and constitutions in the respective image forming portions Pa, Pb, Pc and Pd, suffixes a, b, c and d representing the elements for associated colors are omitted, and the elements will be collectively described in some instances. FIG. 2 is a schematic sectional view of the image forming portion P. In this embodiment, the image forming portion P is constituted by including a photosensitive drum 1, a charging roller 2, an exposure device 3, a developing device 4, a primary transfer roller 5, a drum cleaning device 6, and the like, which are described later.

The photosensitive drum 1 which is a drum-shaped photosensitive member (electrophotographic photosensitive member) as an image bearing member is rotationally driven in an indicated arrow R1 direction (clockwise direction) in FIG. 1 at a predetermined peripheral speed (process speed) of 100 mm/sec by a drum driving motor M1 (FIG. 10) as a driving means. A surface of the rotating photosensitive drum 1 is electrically charged uniformly to a predetermined polarity (negative in this embodiment) and a predetermined potential by the charging roller 2 as a charging means. During a charging step, to the charging roller 2, a charging voltage (charging bias) which is a DC voltage of a negative polarity is applied from a charging voltage source (high voltage source circuit) E1. The charging voltage may also be an oscillating voltage in the form of an AC voltage biased with a DC voltage.

The surface of the charged photosensitive drum 1 is subjected to scanning exposure to light by the exposure device (laser scanner) 3 as an exposure means, so that an electrostatic latent image (electrostatic image) is formed on the photosensitive drum 1. In this embodiment, an electrostatic latent image forming means for forming the electrostatic latent image on each of the plurality of image bearing members is constituted by the charging rollers 2*a*-2*d* and the exposure devices 3*a*-3*d*. The electrostatic image formed on the photosensitive drum 1 is developed by supplying the toner as a developer by the developing device 4 as a developing means, so that the toner image is formed on the photosensitive drum 1. The developing device 4 includes a developing roller 41 feeding the toner to an opposing portion (developing portion) to the photosensitive drum 1 while carrying the toner and includes a developing container 42 for accommodating the toner. The developing rollers 41*a*-41*d* are provided correspondingly to the plurality of image bearing members, respectively, and are an example of a plurality of developing members (developer carrying members) for developing the electrostatic latent images on the image bearing members with toners under application of a developing voltage. During development, to each of the developing rollers 41, the developing voltage (developing bias), which is an oscillating voltage in the form of an AC voltage biased with a DC voltage, is applied from a developing voltage source (high voltage source circuit) E2. A DC component of the developing voltage is set at a predetermined negative potential between a charge potential and an exposed portion potential of the photosensitive drum 1. In this embodiment, the toner negatively charged to the same polarity (negative in this embodiment) as the charge polarity of the photosensitive drum 1 is deposited on an exposed portion of the photosensitive drum 1 which is lowered in absolute value of the potential by the exposure to light after the photosensitive drum 1 is charged uniformly. That is, in this embodiment, the charge polarity (normal charge polarity) of the toner during the development is the negative polarity. In this embodiment, as shown in (a) of FIG. 13, to the respective developing rollers 41*a*-41*d* of the image forming portions Pa-Pd, the developing voltage is applied from independent developing voltage sources E2*a*-E2*d*.

An endless belt-shaped intermediary transfer belt 7 as an intermediary transfer member is provided opposed to the respective photosensitive drums 1 of the image forming portions Pa-Pd. The intermediary transfer belt 7 is an example of a conveying member for carrying and conveying the toner images transferred from the plurality of the image bearing members. The intermediary transfer belt 7 is extended around a driving roller 13, a tension roller 12 and an idler roller 11 which are used as a plurality of stretching rollers (supporting rollers), and is stretched with a predetermined tension. In this embodiment, the intermediary transfer belt 7 is formed with an endless film formed of polyimide, which is an example of a dielectric resin material. The driving roller 13 is rotationally driven by a belt driving motor M2 (FIG. 10) as a driving means, whereby the intermediary transfer belt 7 is rotated (circulated and moved) in an arrow R2 direction (counterclockwise direction) in FIG. 1. In an inner peripheral surface side of the intermediary transfer belt 7, primary transfer rollers 5*a*-5*d* which are roller-type primary transfer members as primary transfer means are provided correspondingly to the photosensitive drums 1*a*-1*d*. Each of the primary transfer rollers 5 is pressed (urged) against the intermediary transfer belt 7 toward the photosensitive drum 1, so that a primary transfer portion (primary transfer nip) N1 is formed where the photosensitive drum 1 and the intermediary transfer belt 7 contact each other.

The toner image formed on the rotating photosensitive drum 1 is transferred (primary-transferred) electrostatically onto the intermediary transfer belt 7. During a primary transfer step, to the primary transfer roller 5, a primary transfer voltage (primary transfer bias) which is a DC voltage of an opposite polarity to the normal charge polarity of the toner is applied from a primary transfer voltage source (high voltage source circuit) E3. For example, during full-color image formation, the respective color toner images of yellow, magenta, cyan and black formed on the respective photosensitive drums 1*a*-1*d* are successively transferred superposedly onto the intermediary transfer belt 7.

The toner (residual toner) remaining on the surface of the photosensitive drum 1 without being transferred onto the intermediary transfer belt 7 during the primary transfer is removed and collected from the surface of the photosensitive drum 1 by the drum cleaning device 6 as a photosensitive member cleaning means. The drum cleaning device 6 scrapes off the residual toner from the surface of the rotating photosensitive drum 1 by a cleaning blade 61 as a cleaning member, so that the residual toner is accommodated in a cleaning container 62. The toner accommodated in the cleaning container 62 is fed to a collecting toner container (not shown) by a feeding screw 63.

At a position opposing the driving roller 13 also functioning as a secondary transfer opposite roller on an outer peripheral surface side of the intermediary transfer belt 7, a secondary transfer roller 14 which is a roller-type secondary transfer member as a secondary transfer means is provided. The secondary transfer roller 14 is pressed (urged) against the intermediary transfer belt 7 toward the driving roller 13 and forms a secondary transfer portion (secondary transfer nip) N2 where the intermediary transfer belt 7 and the secondary transfer roller 14 are in contact with each other.

The toner images formed on the intermediary transfer belt 7 as described above are transferred (secondary-transferred) electrostatically onto the recording material S, such as paper, nipped and fed at the secondary transfer portion N2 by the intermediary transfer belt 7 and the secondary transfer roller 14. During a secondary transfer step, to the secondary transfer roller 14, a secondary transfer voltage (secondary transfer bias) which is a DC voltage of an opposite polarity to the normal charge polarity of the toner during primary transfer is applied from a secondary transfer voltage source (high voltage source circuit) E4. The recording material S is accommodated in a recording material accommodating cassette (not shown) and is fed to a registration roller pair 15 by a feeding and conveying device (not shown) including a feeding roller, a conveying roller and a conveying guide and the like.

The toner (residual toner) remaining on the surface of the intermediary transfer belt without being transferred onto the recording material S during the secondary transfer is removed and collected from the surface of the intermediary transfer belt 7 by a belt cleaning device 9 as an intermediary transfer member cleaning means. The belt cleaning device 9 scrapes off the residual toner from the surface of the rotating intermediary transfer belt 7 by a cleaning blade 91 as a cleaning member, and accommodates the residual toner in a belt cleaning container 92. The toner accommodated in the belt cleaning container 92 is fed to a cleaning toner container (not shown) by a feeding member (not shown). The belt cleaning device 9 is disposed at a position opposing the tension roller 12 via the intermediary transfer belt 7.

The recording material S on which the toner image is transferred is fed to a fixing device 16 as a fixing means. The recording material S is, after the toner image is fixed (melt-fixed) on the surface thereof by being heated and pressed by the fixing device 16, discharged (outputted) to an outside of the apparatus main assembly 110 of the image forming apparatus 100.

In this embodiment, in each of the image forming portions P, the photosensitive drum 1, the charging roller 2, the developing device 4 and the drum cleaning device 6 are integrally assembled with a cartridge container 8 into a unit, and constitute a process cartridge 10 detachably mountable to the apparatus main assembly 110.

In this embodiment, the intermediary transfer belt 7, the stretching rollers 11, 12 and 13, the primary transfer rollers 5*a*-5*d* and the like are supported by a unit frame 71 (FIG. 4) as a supporting member, and integrally constitute an intermediary transfer unit 70 detachably mountable to the apparatus main assembly 110.

2. Contact and Spacing Mechanism

In this embodiment, the image forming apparatus 100 is capable of executing the image formation by operations in two image forming modes consisting of a full-color mode (first mode) and a black (monochromatic) mode (second mode). In the operation in the full-color mode, the toner images are formed by the first to fourth image forming portions Pa-Pd, so that a full-color image can be formed. In the operation in the black mode, the toner image is formed only by the fourth image forming portion Pd of the first to fourth image forming portions Pa-Pd, so that a black (monochromatic) image can be formed. In this embodiment, the image forming apparatus 100 includes a contact and spacing mechanism 20 (FIG. 4) for causing the intermediary transfer belt 7 to contact the photosensitive drums 1*a*-1*d* and the space the intermediary transfer belt 7 from the photosensitive drum 1*a*-1*d* by moving the primary transfer rollers 5*a*-5*d* in an approaching direction or a spacing direction with respect to the photosensitive drums 1*a*-1*d*.

Figure 3:
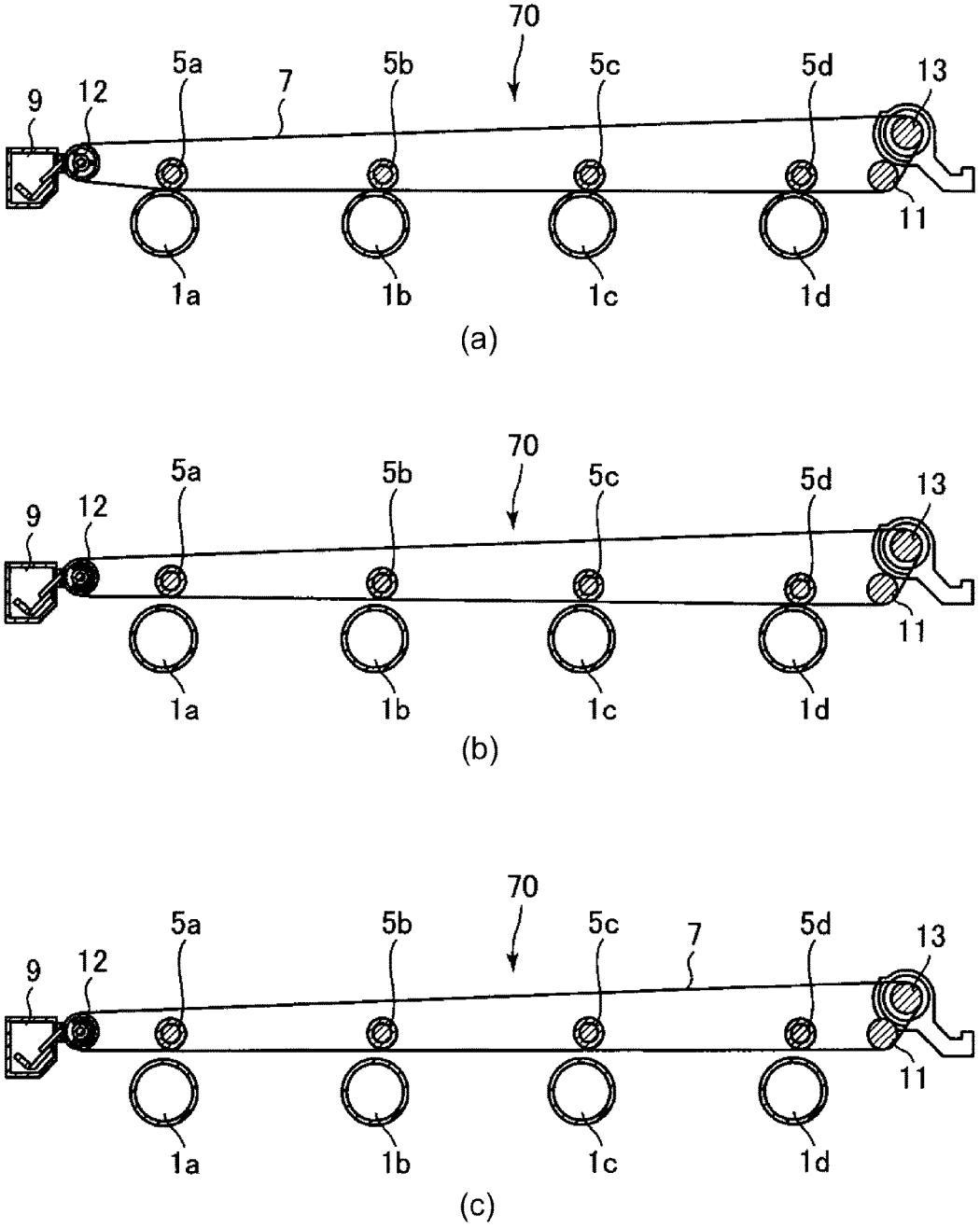
In FIG. 3, (*a*) to (*c*) are schematic sectional views of an intermediary transfer unit for illustrating a contact and spacing state.

In FIG. 3, (*a*) to (*c*) are schematic sectional views showing three contact and spacing states between the intermediary transfer belt 7 and the photosensitive drums 1*a*-1*d* in this embodiment.

In FIG. 3, (*a*) shows an "all contact state". In the "all contact state", in all of the image forming portions Pa-Pd, the primary transfer rollers 5*a*-5*d* are pressed against the intermediary transfer belt 7 toward the photosensitive drums 1*a*-1*d*, so that the intermediary transfer belt 7 is contacted to the photosensitive drums 1*a*-1*d*. In this embodiment, during the operation in the full-color mode, the "all contact state" is formed.

In FIG. 3, (*b*) shows a "black contact state". In the "black contact state", in the first to third image forming portions Pa-Pc, the primary transfer rollers 5*a*-5*c* are moved away from the photosensitive drums 1*a*-1*c*, so that the intermediary transfer belt 7 is spaced from the photosensitive drums 1*a*-1*c*. Further, in the fourth image forming portion Pd, the primary transfer roller 5*d* is pressed against the intermediary transfer belt 7 toward the photosensitive drum 1*d*, so that the intermediary transfer belt 7 is contacted to the photosensitive drum 1*d*. In this embodiment, during the operation in the black mode, the "black contact state" is formed, and in addition, the "black contact state" is set at a home position of the intermediary transfer unit 70 during stand-by of a print job or the like. During the operation in the black mode, in the first to third image forming portions Pa-Pd, the operations of the photosensitive drums 1*a*-1*c*, the developing devices 4*a*-4*c*, and the like are stopped. As a result, deterioration due to abrasion or the like of the photosensitive drums 1*a*-1*c*, the primary transfer rollers 5*a*-5*c* and the intermediary transfer belt 7 which are not used in the image formation by the operation in the black mode is suppressed, so that lifetime extension of these members can be realized.

In FIG. 3, (*c*) shows an "all spaced state". In the "all spaced state", in all of the image forming portions Pa-Pd, the primary transfer rollers 5*a*-5*d* are moved away from the photosensitive drums 1*a*-1*d*, so that the intermediary transfer belt 7 is spaced from the photosensitive drums 1*a*-1*d*. In this embodiment, the "all spaced state" is formed during mounting and demounting of the intermediary transfer unit 70 with respect to the apparatus main assembly 110. As a result, during the mounting and demounting of the intermediary transfer unit 70 with respect to the apparatus main assembly 110, generation or the like of damage such as scars on the photosensitive drums 1*a*-1*d* and the intermediary transfer belt 7 due to friction between the photosensitive drums 1*a*-1*d* and the intermediary transfer belt 7 can be suppressed.

In this embodiment, the contact and spacing mechanism 20 is constituted so as to move also the idler roller 11 in synchronism with movement of the primary transfer roller 5*d* of the fourth image forming portion Pd. As a result, the intermediary transfer belt 7 is spaced from the photosensitive drums 1*a*-1*d* of all of the image forming portions Pa-Pd with reliability.

Figure 4:
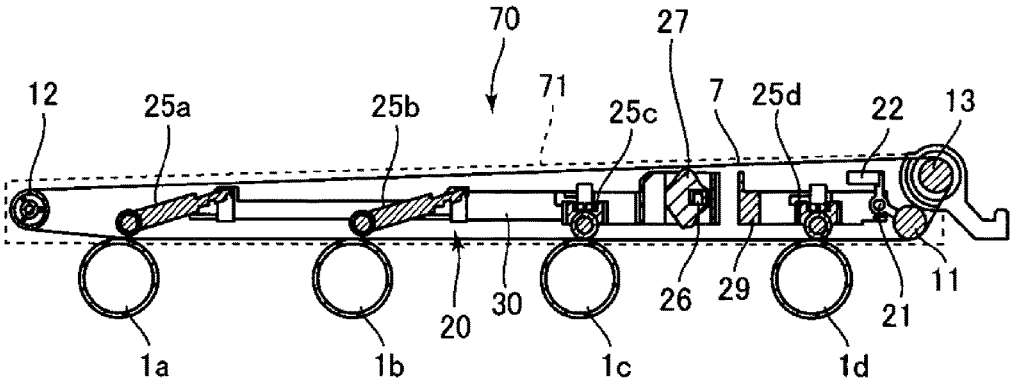
FIG. 4 is a schematic sectional view of the intermediary transfer unit including a contact and spacing mechanism.
Figure 5:
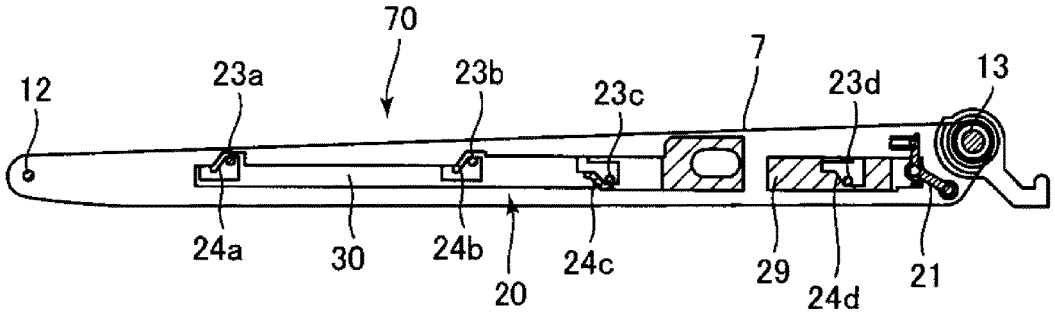
In FIG. 5, (*a*) to (*c*) are schematic sectional views of the intermediary transfer unit including the contact and spacing mechanism.
Figure 5:
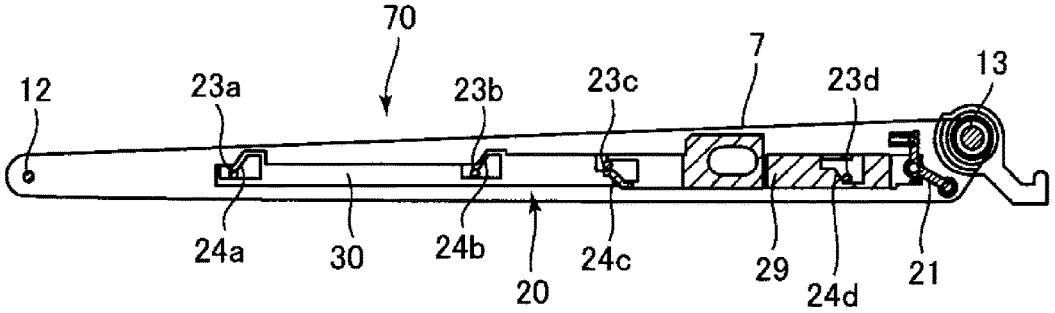
Figure 5:
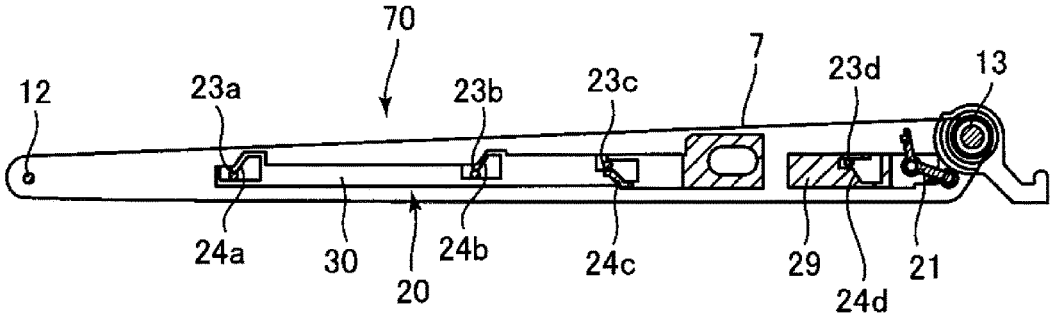
Figure 6:
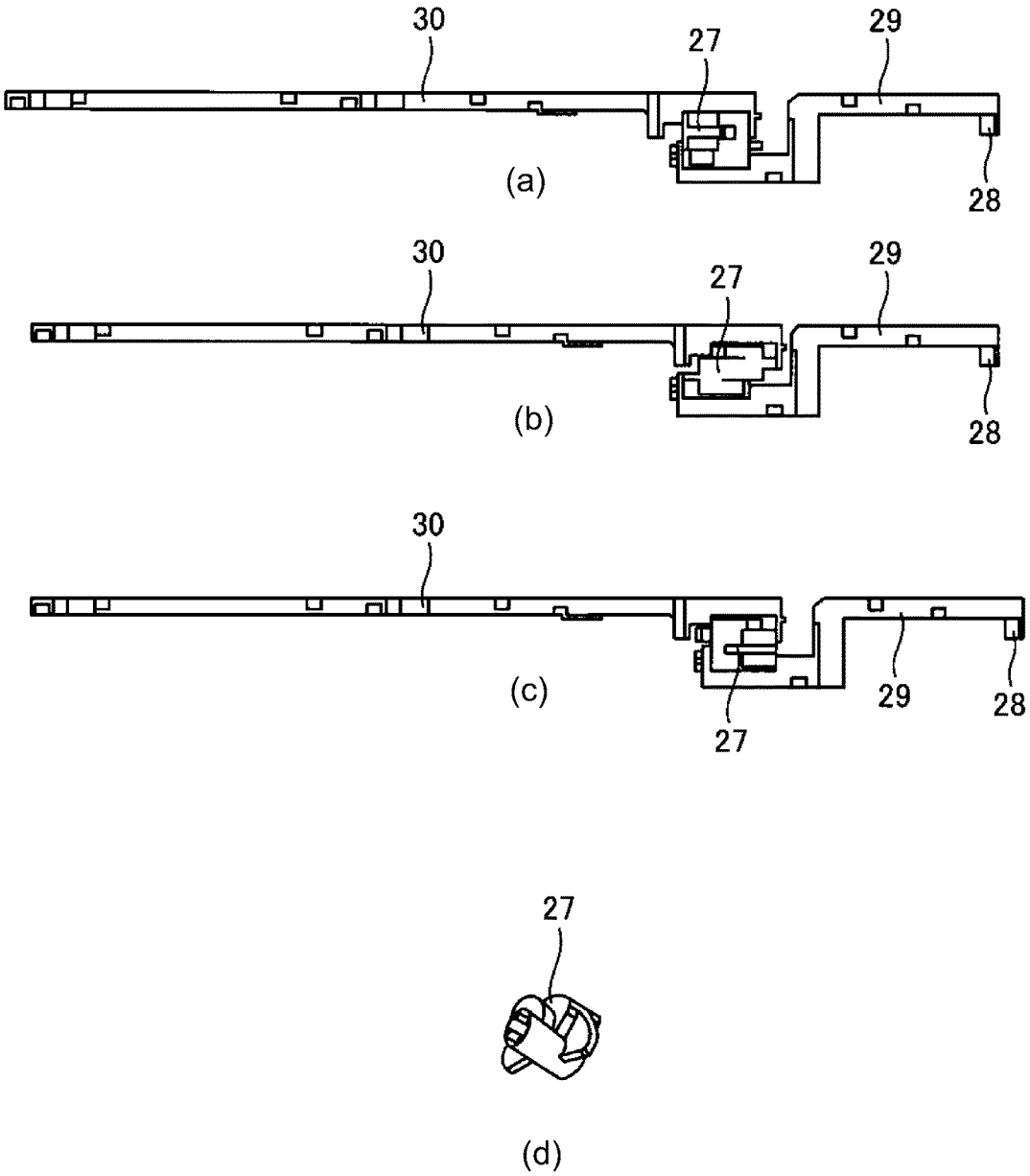
In FIG. 6, (*a*) to (*c*) are plan views each showing a cam and a slider of the contact and spacing mechanism, and (*d*) is a perspective view of the cam.
Figure 7:
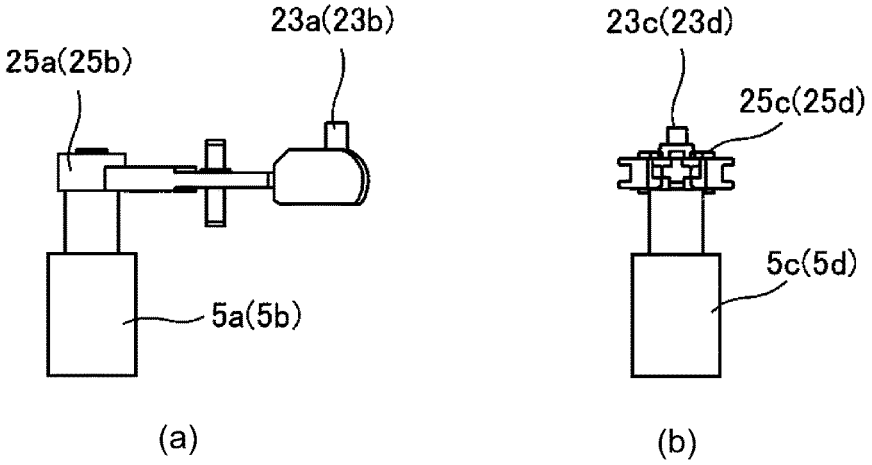
In FIG. 7, (*a*) and (*b*) are plan views each showing a primary transfer holder of the contact and spacing mechanism.

An operation of the contact and spacing mechanism 20 will be described also with reference to FIGS. 4 to 7. FIG. 4 and (*a*) to (*c*) of FIG. 5 are schematic sectional views of the intermediary transfer unit 70 for illustrating the operation of the contact and spacing mechanism 20 and each showing a part of elements necessary for explanation. In FIG. 6, (*a*) to (*c*) are plan views for illustrating operations of a cam 27 and sliders (movable members) 29 and 30, of the contact and spacing mechanism 20, which are described later, and (*d*) is a perspective view of the cam 27. In FIG. 7, (*a*) and (*b*) are plan views each showing a primary transfer holder (bearing member) 25 described later.

As shown in FIG. 4, the contact and spacing mechanism 20 includes a rotation shaft 26 supported by the unit frame 71 rotatably about a rotational axis substantially parallel to rotational axis directions of the primary transfer rollers 5*a*-5*d* and the stretching rollers 11, 12 and 13. The rotation shaft 26 is connected with a contact and spacing motor M3 (FIG. 10), as a driving means (driving source) provided in the apparatus main assembly 110, in a state in which the intermediary transfer unit 70 is mounted in the apparatus main assembly 110, so that a driving force is inputted to the rotation shaft 26. The cam 27 is fixed to each of end portions of the rotation shaft 26 with respect to the rotational axis direction in an inside of the unit frame 71.

In this embodiment, the cams 27 provided at the end portions of the rotation shaft 26 with respect to the rotational axis direction have a line-symmetrical constitution with respect to a substantially center line of a widthwise direction (substantially perpendicular to a movement direction) of the intermediary transfer belt 7. Further, the sliders 29 and 30, holders 21 and 25 and the like, which are described later, are provided correspondingly to each of the cams 27 so as to have a line-symmetrical constitution with respect to the substantially center line of the widthwise direction of the intermediary transfer belt 7. Further, the cams 27 act on the corresponding sliders 29 and 30 and holders 21 and 25 and the like so as to move these members in the same direction in synchronism with each other. Accordingly, in the following, description will be made by paying attention to one of the cams 27 and its associated elements.

As shown in FIG. 4, the contact and spacing mechanism 20 includes a black slider 29 and a color slider 30 which are supported by the unit frame 71 so as to be movable by being engaged with the cam 27. By rotating the cam 27, each of the black slider 29 and the color slider 30 is moved in a left-right direction in the figure. As shown in FIG. 4, the primary transfer rollers 5*a*-5*d* are rotatably supported by primary transfer holders 25*a*-25*d* movably supported by the unit frame 71. Further, as shown in (a) and (b) of FIG. 7, the primary transfer holders 25*a*-25*d* are provided with projections 23*a*-23*d*. In this embodiment, the primary transfer holders 25*a* and 25*b* supporting the primary transfer rollers 5*a* for yellow and 5*b* for magenta have the same constitution, and the primary transfer holders 25*a* and 25*d* supporting the primary transfer rollers 5*c* for cyan and 5*d* for black have the same constitution. Further, as shown in FIG. 5, the projection 23*d* provided on the primary transfer holder 25*d* for black engages with an inclined surface portion 24*d* of the black slider 29. The projections 23*a*-23*c* provided on the primary transfer holders 25*a*-25*c* for yellow, magenta and cyan engage with inclined surface portions 24*a*-24*c*, respectively, of the color slider 30. In this state, by moving the black slider 29 and the color slider 30 in the left-right direction in the figure, the primary transfer rollers 25*a*-25*d* are moved in the approaching direction or the spaced direction with respect to the photosensitive drums 1*a*-1*d*.

Further, as shown in FIG. 4, the idler roller 11 is rotatably supported by an idler roller holder (bearing member) 21 rotatably supported by the unit frame 71. The idler roller holder 21 is pressed by an urging (pressing) spring 22 from an inside toward an outside of the intermediary transfer belt 7 and is abutted against a rail (not shown) provided in the apparatus main assembly 110, and thus is positioned. When the black slider 29 is moved, the idler roller holder 21 is pushed up in a direction from the outside toward the inside of the intermediary transfer belt 7 by a pushing-up portion 28 (FIG. 6) provided on the black slider 29. As a result, the idler roller 11 is moved in a direction of being moved away from the photosensitive drums 1*a*-1*d*.

The contact and spacing mechanism 20 switches the contact and spacing state between the intermediary transfer belt 7 and the photosensitive drums 1*a*-1*d* to three states consisting of the above-described "all contact state", "black contact state" and "all spaced state" depending on a rotation stop position of the cam 27. In FIG. 5, (*a*), (*b*) and (*c*) correspond to the "all contact state", the "black contact state" and the "all spaced state", respectively. In FIG. 6, (*a*), (*b*) and (*c*) show positional relationships among the cam 27, the black slider 29 and the color slider 30 in the states shown in (a), (b) and (c) of FIG. 15, respectively. The cam 27 has a cam surface engageable with the black slider 29 and a cam surface engageable with the color slider 30, and is constituted so that each of the black slider 29 and the color slider 30 produces different motions every 120°. That is, (a) to (c) of FIG. 5 and (a) to (c) of FIG. 6 show a change in state when the cam 27 is rotated by angles of 120°. Specifically, (a) of FIG. 5 and (a) of FIG. 6 show a state in which the black slider 29 and the color slider 30 are completely moved to the left side in the figures. Further, (b) of FIG. 5 and (b) of FIG. 6 show a state in which the black slider 29 is completely moved to the left side in the figures and the color slider 30 is completely moved to the right side in the figures. Further, (c) of FIG. 5 and (d) of FIG. 6 show a state in which the black slider 29 and the color slider 30 are completely moved to the right side in the figures. The above-described switching among the three contact and spacing states can be carried out by combining the movement directions with the shapes of the above-described inclined surface portions 24*a*-24*d* and the shape of the pushing-up portion 28.

In this embodiment, the contact and spacing mechanism 20 is constituted by the contact and spacing motor M3, the rotation shaft 26, the cam 27, the sliders 29 and 30, the holders 21 and 25, and the like.

3. Control Mode

Figure 10:
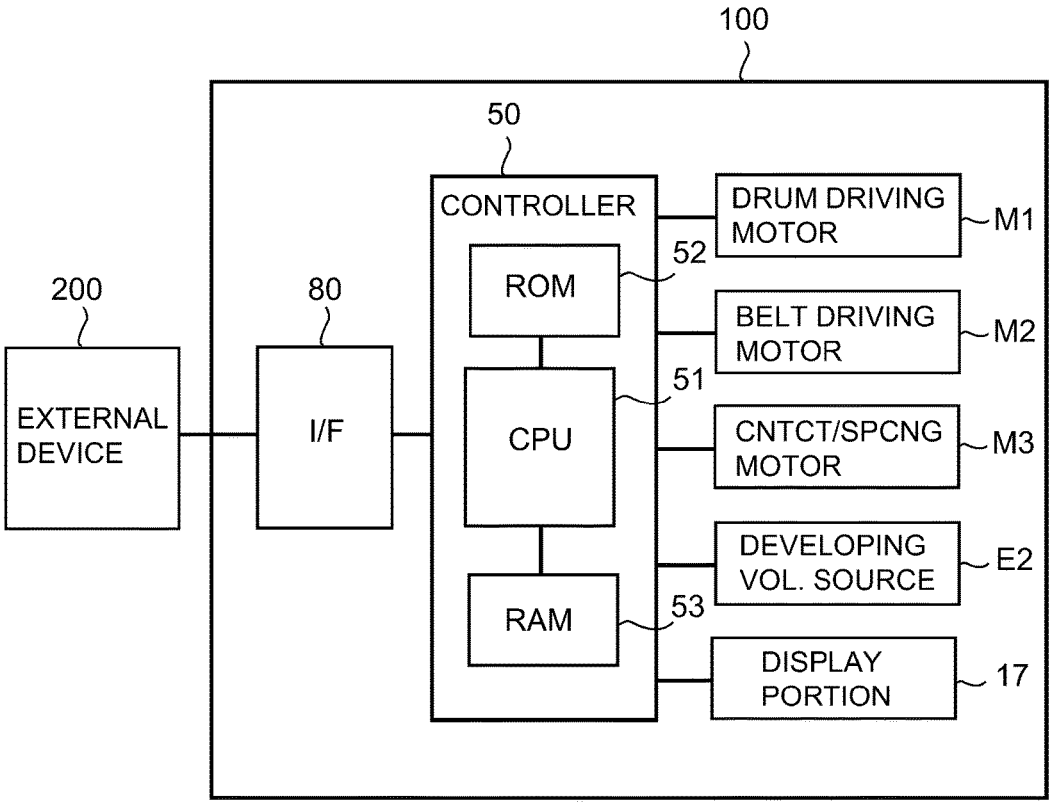
FIG. 10 is a block diagram showing a control mode of a principal part of the image forming apparatus.

FIG. 10 is a block diagram showing a schematic control mode of a principal part of the image forming apparatus 100 in this embodiment. In this embodiment, operations of the respective portions of the image forming apparatus 100 are controlled in an integrated manner by a controller 50 provided in the apparatus main assembly 110. The controller 50 includes, as main constituent elements, a CPU 51 as a computation (calculation) control means and a ROM 52 and a RAM 53 which are used as storing means. In the apparatus main assembly 110 of the image forming apparatus 100, communication I/F portion 80 as a communication means is provided. The controller 50 is connected with an external device 200 such as a personal computer via the communication I/F portion 80. The CPU 51 reads a necessary program from the ROM 52 and controls the respective portions of the image forming apparatus 100 on the basis of data of a print job received through the communication I/F portion 80, for example, and thus causes the image forming apparatus 100 to execute the print job. The image forming apparatus 100 includes an unshown original reading device and can also execute the print job (copying) on the basis of original image data. The print job is a series of operation sequences, for forming and outputting the image(s) on a single or a plurality of recording materials, started in accordance with a single start instruction.

The apparatus main assembly 110 of the image forming apparatus 100 is provided with an operation display portion (operation panel) 17. The operation display portion 17 has a function of an operating portion for inputting various pieces of information on operation setting of image formation to the controller 50 and a function of a display portion for displaying information for an operator such as a user or a service person. In this embodiment, the operation display portion 17 is in the form of a touch panel which can be touch-operable by the operator.

In this embodiment, particularly, the controller 50 not only causes the contact and spacing mechanism 20 to operate depending on the image forming mode but also effects control of changing setting of the developing voltage applied to the developing roller 41*d* for black depending on the image forming mode as described later.

4. Operation Sequence of Print Job

Figure 8:
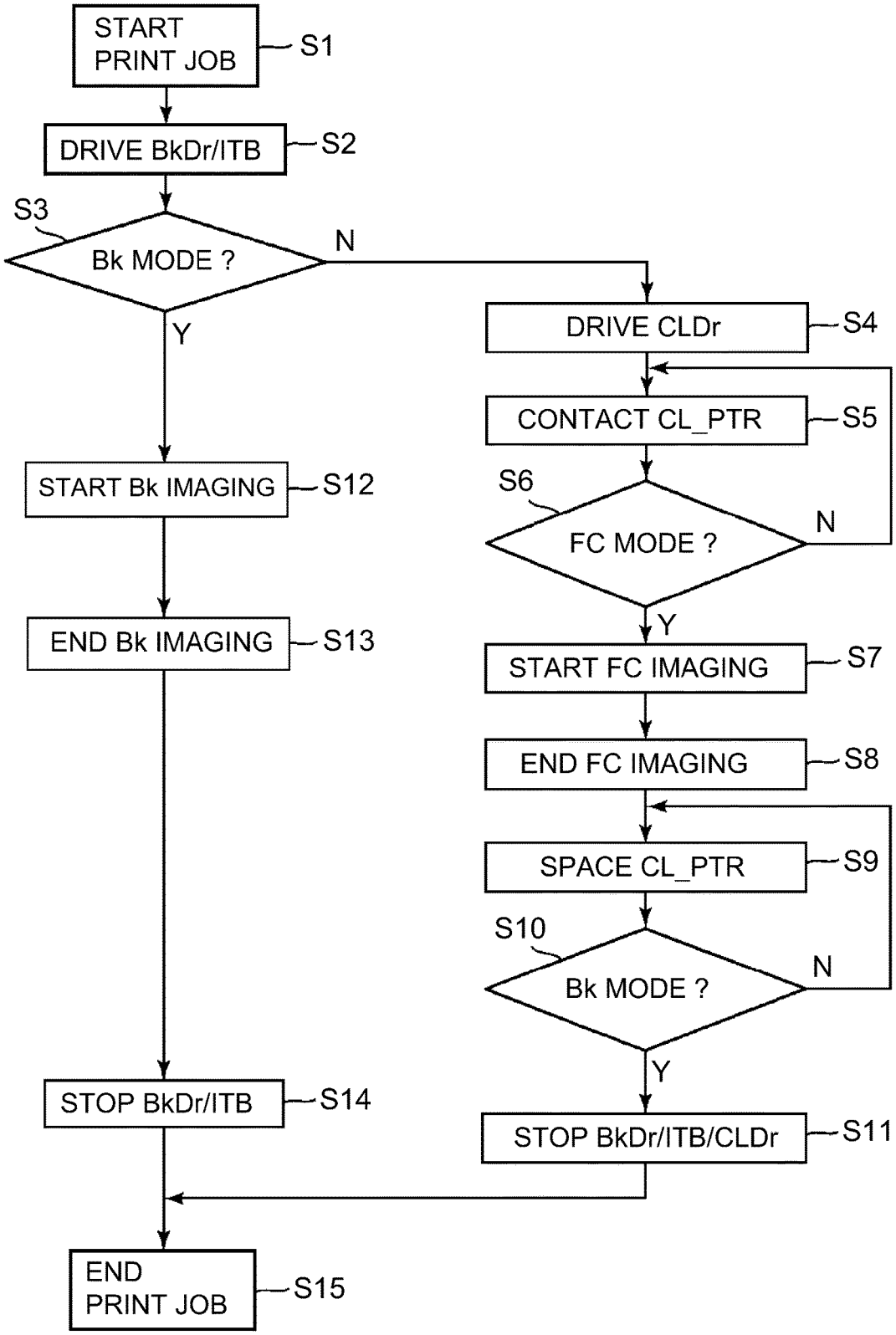
FIG. 8 is a flowchart of a print job.

With reference to FIG. 8, an operation sequence of the print job will be described. In the figure, "Bk" is the black, "CL" is the color (in this case, refers to the yellow, the magenta and the cyan), "FC" is full-color, "Dr" is the photosensitive drum, and "ITB" is the intermediary transfer belt.

When the controller 50 receives the print job, the controller 50 starts the print job (S1), and starts drive of the photosensitive drum 1*d* for black and the intermediary transfer belt 7 (S2). Then, the controller 50 discriminates whether the print job should be performed by the operation in the black mode or the operation in the full-color mode (S3).

In S3, in the case where the controller 50 discriminated that the print job should be performed by the operation in the full-color mode, the controller 50 starts drive of the photosensitive drums 1*a*-1*c* for color (S4). Then, the controller 50 causes the contact and spacing mechanism 20 to move the primary transfer rollers 5*a*-5*c* for color, so that the intermediary transfer belt 7 is contacted to the photosensitive drums 1*a*-1*c* for color (S5). Then, the controller 50 checks whether or not the respective primary transfer rollers 5*a*-5*d* are disposed at predetermined positions (i.e., are in the "all contact state"), by a position detecting mechanism (not shown) (S6). In S6, in the case where the controller 50 discriminated that the primary transfer rollers 5*a*-5*d* are disposed at the predetermined positions, the color slider 50 starts full-color image formation (S7) and ends the image formation when the images are formed on a designated number of sheets (recording materials) (S8). Thereafter, the controller 50 causes the contact and spacing mechanism 20 to space the primary transfer rollers 5*a*-5*c* for color from the photosensitive drums 1*a*-1*c* for color (S9). Then, the controller 50 checks whether or not the respective primary transfer rollers 5*a*-5*d* are disposed at predetermined positions (i.e., in the "black contact state"), by the position detecting mechanism (S10). In S10, in the case where the controller 50 discriminated that the primary transfer rollers 5*a*-5*d* are disposed at the predetermined positions, the controller 50 stops drive of the photosensitive drum 1*d* for black, the photosensitive drums 1*a*-1*c* for color and the intermediary transfer belt 7 (S11), and then ends the print job (S15).

On the other hand, in S3, in the case where the controller 50 discriminated that the print job should be performed in the operation in the black mode, the color slider 50 starts black image formation (S12) and ends the image formation when the images are formed on a designated number of sheets (recording materials) (S13). Thereafter, the controller 50 stops drive of the photosensitive drum 1*d* for black color and the intermediary transfer belt 7 (S14), and then ends the print job (S15).

In this embodiment, as regards the contact and spacing state between the intermediary transfer belt 7 and the photosensitive drums 1*a*-1*d*, the position of the "belt contact state" is a home position during standby of the print job (stand-by state). However, the present invention is not limited thereto. For example, the position of the "all spaced state" may also be the home position. Or, the position of the "all contact state" may also be the home position.

When the intermediary transfer unit 70 is demounted from the apparatus main assembly 110, for example, through the operation display portion 17, it is possible to notify the controller 50 of a message to the effect that the intermediary transfer unit 70 should be demounted (in such a manner that an exchanging button, of the intermediary transfer unit 70, displayed on the operation display portion 17 is pressed). The controller 50 responds to this notification, so that the controller 50 can cause the contact and spacing mechanism 20 to switch the contact and spacing state between the intermediary transfer belt 7 and the photosensitive drums 1*a*-1*d* to the "all spaced state".

5. Change of Setting of Developing Voltage

As described above, for example, in the color image forming apparatus as in this embodiment, there arises a problem such that a density of a character image and a line image (particularly thin line image) is ensured while forming a high-quality color image.

In this embodiment, in order to acquire a stable density of the character image and the line image (particularly the thin line image) irrespective of information on an attribute of the image such as object data, the image forming apparatus 100 roughly has the following constitution. That is, particularly, during the operation in the black mode, operation setting other than normal operation setting of the image formation (image forming condition) is selectable, so that the density (or width) of a black character image or line image is adjustable depending on a demand of the user or the like. The normal operation setting is a standard operation setting in the case where the operation setting is not changed in accordance with this embodiment. Specifically, particularly, during the operation in the black mode, it can be assumed that a ratio of the character image or the line image is large. For that reason, in this embodiment, a developing property can be adjusted by changing setting of the developing voltage in operation setting particularly during the operation in the black mode relative to that in the normal operation setting. As a result, typically, a necessary constant of the character image or the line image is ensured, so that it is possible to ensure the density of the black character image or the black line image. Further, by employing such a constitution, the density of the character image or the line image can be adjusted depending on the demand of the user or the like while suppressing a fluctuation in uniform image density over an entirety of the image.

Figure 9:
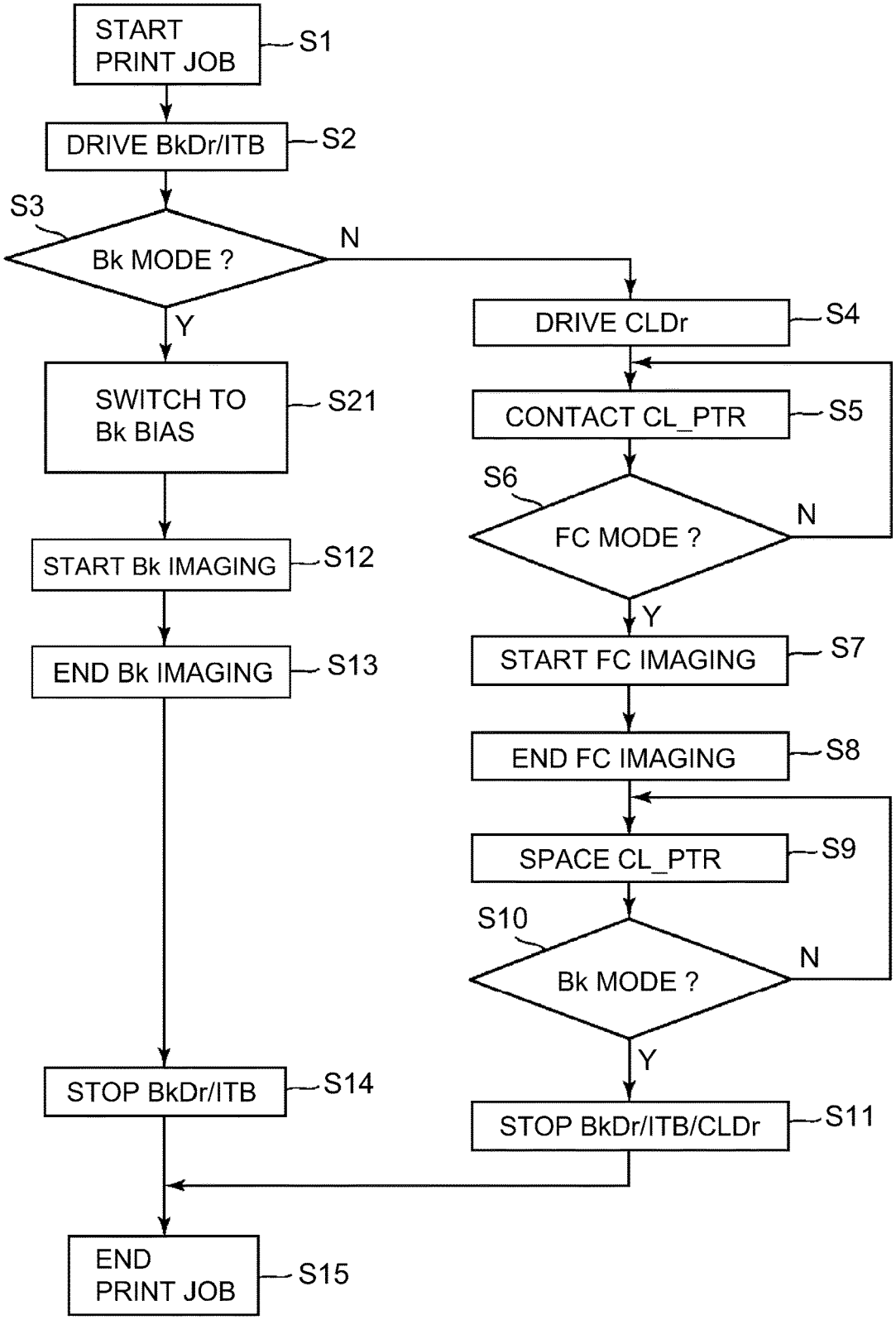
FIG. 9 is a flowchart of a print job in the case where a change in developing voltage during an operation in a monochromatic mode is designated.

With reference to FIG. 9, an outline of an operation sequence of a print job in the case where a change (switching) of setting of the developing voltage for black in the operation in the black mode (in this embodiment, this developing voltage is also referred to as a "black developing voltage") is designated will be described. A method of designating the change of the setting will be described later. In FIG. 9, processes similar to those in FIG. 8 are represented by the same step numbers as in FIG. 8.

When the controller 50 receives the print job, the controller 50 starts the print job (S1), and starts drive of the photosensitive drum 1*d* for black and the intermediary transfer belt 7 (S2). Then, the controller 50 discriminates whether the print job should be performed by the operation in the black mode or the operation in the full-color mode (S3).

In S3, in the case where the controller 50 discriminated that the print job should be performed by the operation in the full-color mode, the controller 50 executes the processes of S4 to S11 similarly as in those described with reference to FIG. 8, and ends the print job (S15). The settings of the developing voltages (normal operation settings) for the respective colors of yellow, magenta, cyan and black during the operation in the full-color mode are the same. However, as described later, the setting of the black developing voltage during the operation in the full-color mode can also be made adjustable relative to the normal operation setting as described later.

On the other hand, in S3, in the case where the controller 50 discriminated that the print job should be performed by the operation in the black mode, the controller 50 changes the setting of the black developing voltage to that during the operation in the black mode, designated as described later (S21).

Thereafter, the controller 50 starts black image formation (S12) and ends the image formation when the images are formed on a designated number of sheets (recording materials) (S13). Thereafter, the controller 50 stops drive of the photosensitive drum 1*d* for black color and the intermediary transfer belt 7 (S14), and then ends the print job (S15). In the case where the change of the setting of the black developing voltage during the operation in the black mode relative to the normal operation setting is not designated, the image formation by the operation in the black mode is executed at the normal operation setting.

In this embodiment, the setting of the black developing voltage during the operation in the black mode can be controlled by the operator such as the user or the service person. In this embodiment, the character image and the line image (particularly the thin line image) can be reproduced in a thick state (high density state) and in a thin state (low density state).

Figure 11:
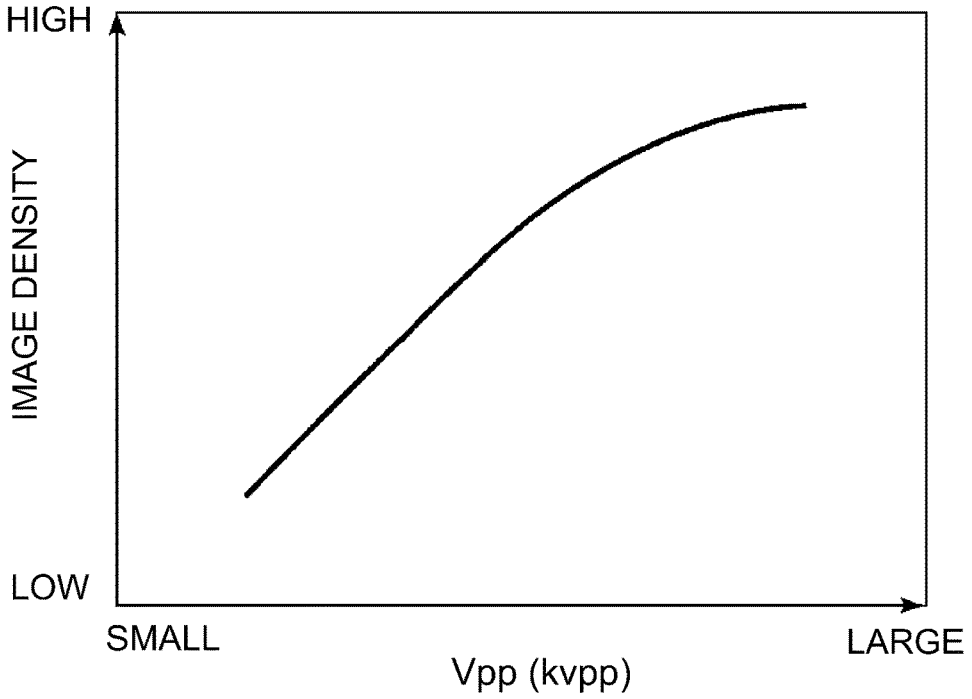
In FIG. 11, (*a*) and (*b*) are graphs each for illustrating an example of control of the developing voltage.
Figure 11:
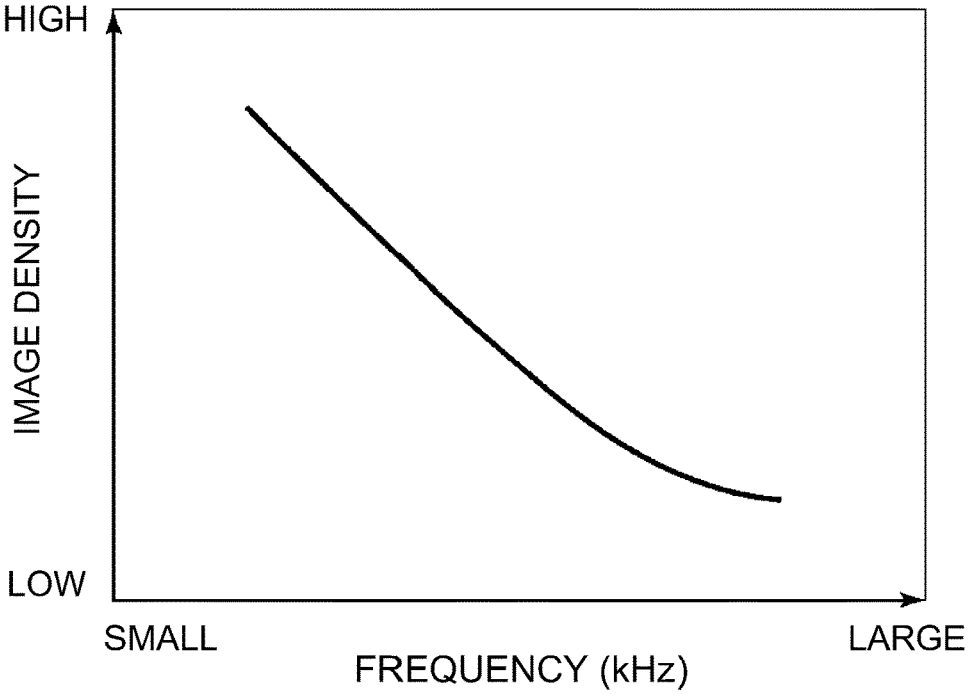

In this embodiment, as described above, the developing voltage is the oscillating voltage in the form of the DC voltage (DC component) biased with the AC voltage (AC component). In this embodiment, as regards the setting of the black developing voltage during the operation in the black mode, a peak-to-peak voltage (Vpp) of the AC component can be changed. In general, a developing property (developing power) changes depending on the AC component of the developing voltage. When the Vpp of the AC component of the developing voltage is increased, a potential difference at a light portion increases and therefore the developing property is improved, so that the image with a high density (thickened thin line) can be obtained. On the other hand, when the Vpp of the AC component of the developing voltage is decreased, the image with a low density (thinned thin line) is obtained. For example, as shown in (a) of FIG. 11, a relationship between the Vpp of the AC component of the developing voltage and the image density can be acquired in advance by an experiment or the like. Specifically, in this embodiment, the Vpp of the AC component (common to all of the colors in this embodiment) of the developing voltage in the normal operation setting is 1.6 Kvpp. With reference to this normal operation setting, the Vpp of the AC component of the developing voltage during the operation in the black mode can be increased and decreased in a predetermined range on a predetermined changing rate (e.g., 100 Vpp) basis. In the case where the density of the character image or the line image is intended to be increased (i.e., in the case where the thin line is intended to be thickened), setting is made so as to increase the Vpp. On the other hand, in the case where the density of the character image or the line image is intended to be decreased (i.e., in the case where the thin line is intended to be thinned), setting is made so as to decrease the Vpp.

The setting of the black developing voltage during the operation in the black mode can be made by changing a frequency of the AC component in place of or in addition to the change of the Vpp. In general, when the frequency is decreased, toner imparting power increases and therefore the developing property is improved, so that the image with a high density (thickened thin line) can be obtained. On the other hand, when the frequency is increased, the image with a low density (thinned thin line) is obtained. For example, as shown in (b) of FIG. 11, a relationship between the Vpp frequency of the AC component of the developing voltage and the image density can be acquired in advance by an experiment or the like. Specifically, in this embodiment, the frequency of the AC component (common to all of the colors in this embodiment) of the developing voltage in the normal operation setting is 1600 Hz. With reference to this normal operation setting, the frequency of the AC component of the developing voltage during the operation in the black mode can be increased and decreased in a predetermined range on a predetermined changing rate (e.g., 100 Hz) basis. In the case where the density of the character image or the line image is intended to be increased (i.e., in the case where the thin line is intended to be thickened), setting is made so as to increase the Vpp. On the other hand, in the case where the density of the character image or the line image is intended to be decreased (i.e., in the case where the thin line is intended to be thinned), setting is made so as to decrease the Vpp. In the case of enabling the change of both of the Vpp and the frequency, by interrelating the Vpp with the frequency, the setting can be made in advance so that the density of the character image or the line image can be set at a desired density in a predetermined range. The Vpp and the frequency may also be made independently changeable.

Incidentally, as regards the setting of the black developing voltage during the operation in the black mode, in place of or in addition to at least one of the Vpp of the AC component and the frequency, the DC component can be changed. In general, when an absolute value of the DC component of the developing voltage having the normal polarity of the toner is increased, the image with a high density (thickened thin line) can be obtained. On the other hand, when the absolute value of the DC component of the developing voltage having the normal polarity of the toner is decreased, the image with a low density (thinned thin line) is obtained. A relationship between the absolute value of the DC component of the developing voltage and the image density can be acquired in advance by an experiment or the like. In this case, with reference to this normal operation setting, the absolute value of the DC component of the developing voltage of the same polarity as the normal charge polarity of the toner can be increased and decreased in a predetermined range on a predetermined changing rate basis. In the case where the density of the character image or the line image is intended to be increased (i.e., in the case where the thin line is intended to be thickened), setting is made so as to increase the absolute value of the DC component. On the other hand, in the case where the density of the character image or the line image is intended to be decreased (i.e., in the case where the thin line is intended to be thinned), setting is made so as to decrease the absolute value of the DC component. In the case where both of the absolute value of the DC component and at least one of the Vpp and the frequency of the AC component are made changeable, by changing these parameters in interrelation with each other, setting can be made in advance so that the density of the character image or the line image can be set at a desired density in a predetermined range. The absolute value of the DC component and at least one of the Vpp and the frequency of the AC component can be made independently changeable.

Further, in the case where the black developing voltage during the operation in the black mode is changed, in interrelation with this change, a fog-removing voltage (Vback) and laser power (exposure light quantity: light quantity per unit time of light radiation per unit area) of the exposure device 3 may also be changed. For example, in the case where the Vpp of the AC component is changed, the charge potential of the photosensitive drum 1*d* for black by the charging roller 2*d* for black can be changed so as to approach the Vback (dark-portion potential difference) before the change of the Vpp. With the change of the charge potential, in order to ensure a desired light-portion potential difference, the laser power of the exposure device 3*d* for black can be changed correspondingly.

Figure 12:
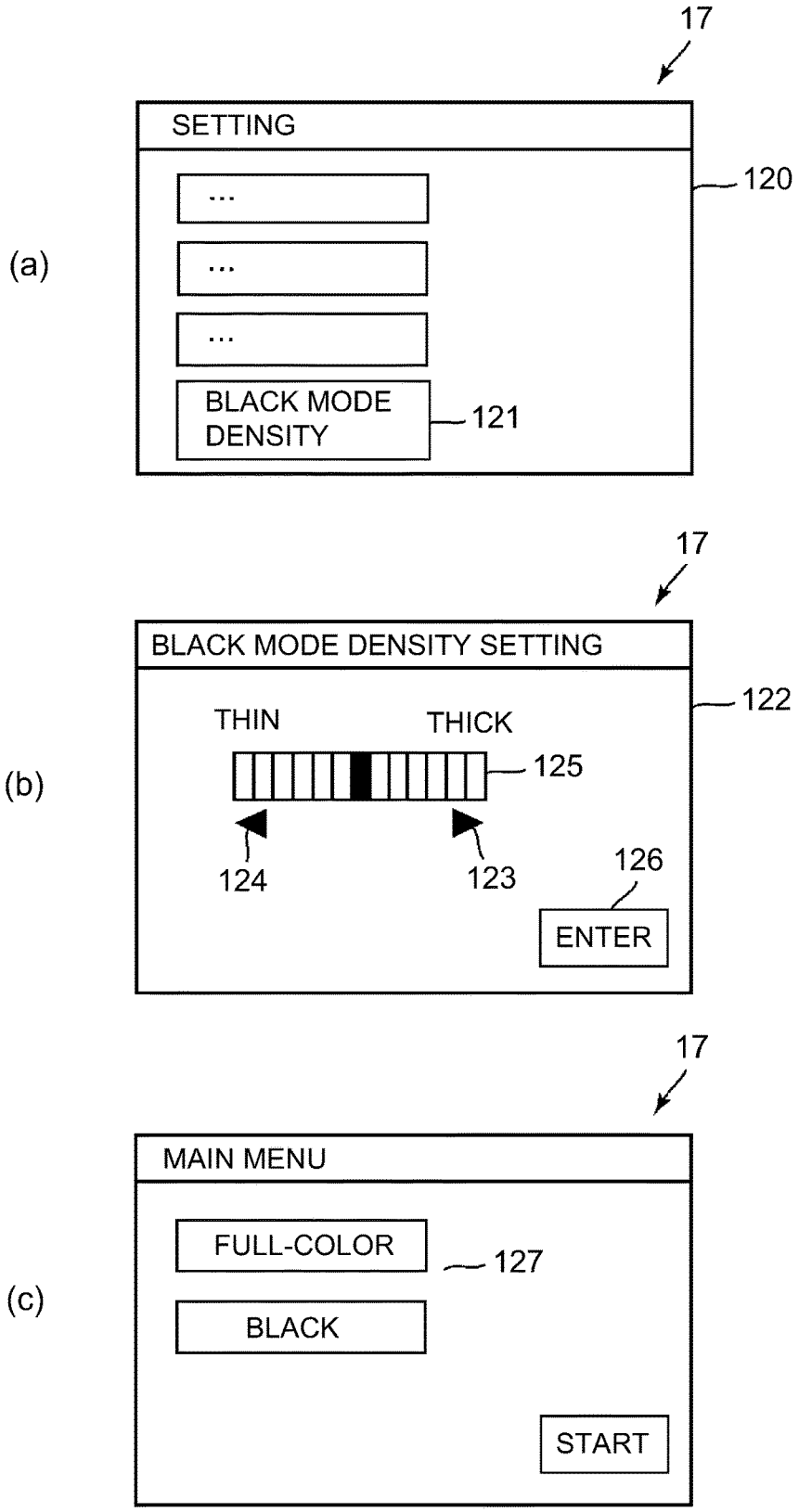
In FIG. 12, (*a*) to (*c*) are schematic views each showing an example of a user interface.

In FIG. 12, (*a*) to (*c*) are schematic views each showing an example of a touch-operable user interface displayed at the operation display portion 17. In this embodiment, through the user interface of the operation display portion 17 of the apparatus main assembly 110, the operator such as the user causes the controller 50 to change the black developing voltage during the operation in the black mode, and is capable of arbitrarily setting a degree of the change. In the case where the operator intends to change the density of the black character image or the black line image during the operation in the black mode, the operator touches a predetermined button (display region) displayed on the operation display portion 17, so that a setting screen 120 capable of selecting various setting items as shown in (a) of FIG. 12 is called up. Further, the operator calls up a density setting screen 122 as shown in (b) of FIG. 12 by touching a density setting button 121 displayed on the setting screen 120. For example, in the case where the operator intends to increase the density of the black character image or the belt line image (i.e., to thicken the thin line) during the operation in the black mode, by touching an increment button 123, the operator can increase a density section 125, set in advance on a predetermined increment basis, to a desired density (level). On the other hand, in the case where the operator intends to decrease the density (i.e., to thin the thin line), by touching a decrement button 124, the operator can decrease the density section 125 to a desired density (level). As a result, the operator is capable of variably setting the black image density during the operation in the black mode. Then, when the operator enters the density setting by touching an enter button 126, the operation display portion 17 inputs the density setting, designated by the operation of the operator, to the controller 50. In the ROM 52 of the controller 50, setting of the black developing voltage during the operation in the black mode is stored correspondingly to the density setting designated as described above. The controller 50 stores and holds, in the RAM 53, the designated density setting or black developing voltage setting corresponding to the designated density setting. Then, when the image formation is carried out by the operation in the black mode, the controller 50 causes the image forming apparatus to form an image in the black developing voltage setting corresponding to the designated density setting (FIG. 9).

The image forming mode may also be selected by the operator by touching a mode selecting button 127 displayed on an initial screen or the like at the operation display portion 17 as shown in (c) of FIG. 12, for example.

Further, the selection of the density setting during the operation in the black mode and the selection of the image forming mode may also be carried out, through a driver software of the image forming apparatus 100, in the external device 200 such as a personal computer communicatably connected with the controller 50.

Thus, the image forming apparatus 100 of this embodiment includes the controller 50 capable of causing the image forming apparatus 100 to carry out the image formation by the operation in a first mode as the image forming mode and by the operation in a second mode as the image forming mode. The first mode (full-color mode) is the image forming mode in which the toner images are formed on, of the plurality of the image bearing members 1, a predetermined image bearing member 1*d* and other image bearing member 1*a*-1*c* different from the predetermined image bearing member 1*d*. The second mode (black (monochromatic) mode) is the image forming mode in which the toner image is formed on the predetermined image bearing member 1*d* but is not formed on other image bearing member 1*a*-1*c*. The image forming apparatus 100 further includes the following designating portion. The designating portion causes the controller 50 to change setting of the developing voltage applied to a predetermined developing member 41*d* which is a developing member corresponding to the predetermined image bearing member 1*d* in the operation in the second mode, relative to setting of the developing voltage applied to the predetermined developing member 41*d* in the operation in the first mode. In this embodiment, the designating means is constituted by the operation display portion 17, the communication I/F portion 80 through which the designation from the external device 200 is inputted to the controller 50, and the like. In the case where the designation by the designating means is made, when the image formation is carried out by the operation in the second mode, the setting of the developing voltage applied to the predetermined developing member 41*d* is changed by the controller 50 relative to the setting of the developing voltage applied to the predetermined developing member 41*d* in the operation in the first mode. Further, in this embodiment, the designating means is capable of variably designating a difference of the setting of the developing voltage applied to the predetermined developing member 41*d* in the operation in the second mode relative to the setting of the developing voltage applied to the predetermined developing member 41*d* in the operation in the first mode. Further, in this embodiment, the image formation by the operation in the second mode is carried out in a state in which the conveying member 7 contacts the predetermined image bearing member 1*d* and is spaced from other image bearing members 1*a*-1*c*.

As described above, in this embodiment, during the operation in the black mode in which it is assumed that an image ratio of particularly the character image or the line image is large, the operation setting different from the normal operation setting is selectable. Further, when the image formation is carried out by the operation in the black mode, the image is formed automatically in the selected operation setting. Accordingly, during the operation in the black mode, irrespective of the information on the attribute of the image such as object data, the density (or the width) of the character image or the line image (particularly the thin line) corresponding to the selection of the operator can be obtained.

Figure 13:
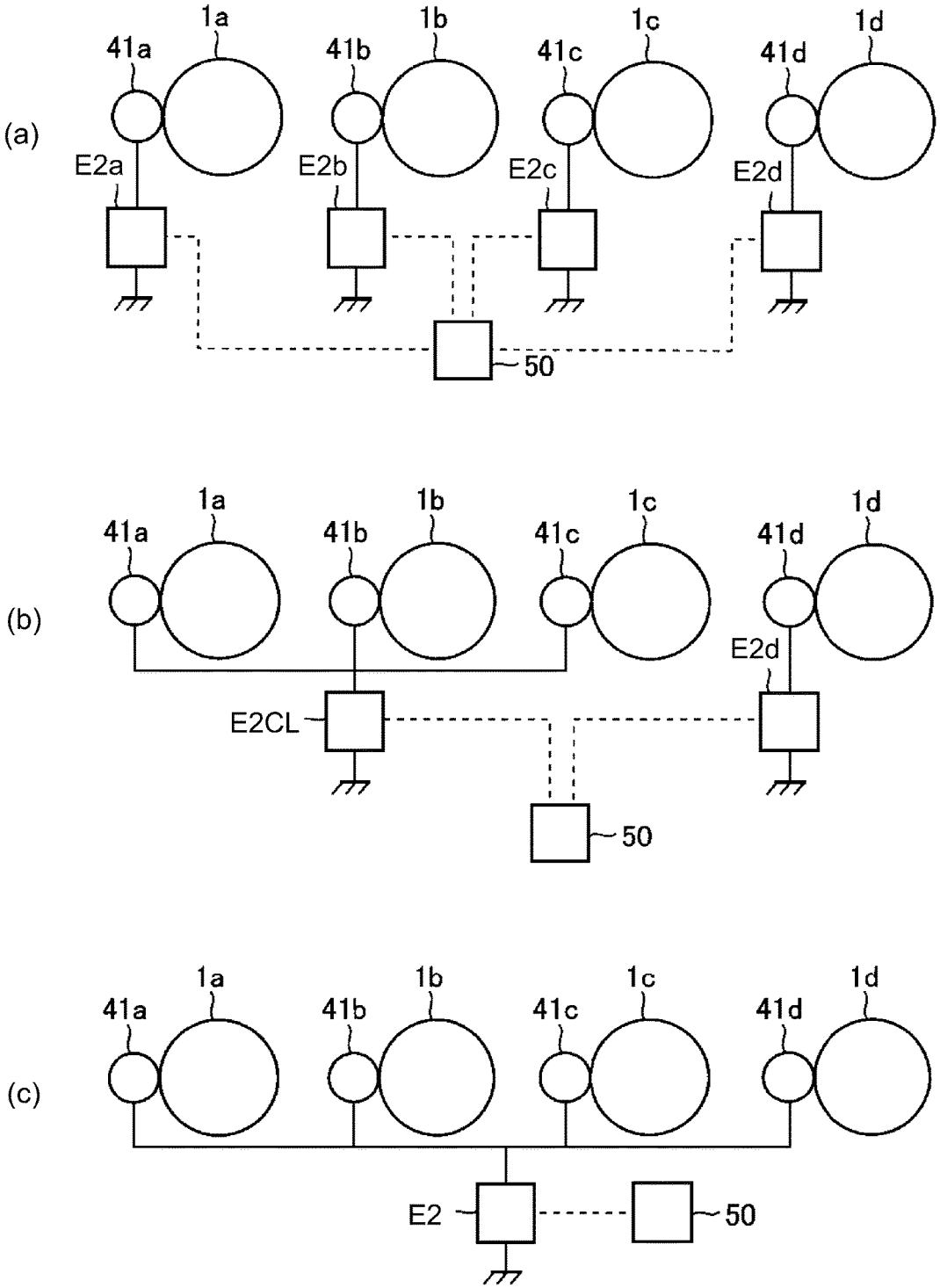
In FIG. 13, (*a*) to (*c*) are schematic views each for illustrating a structural example of a developing voltage source.

In this embodiment, as shown in (*a*) of FIG. 13, to the respective developing rollers 41*a*-41*d* of the image forming portions Pa-Pd, the developing voltage is applied from independent developing voltage sources E2*a*-E2*d*, respectively. For that reason, not only in the operation in the black mode but also in the operation in the full-color mode, it is possible to select the operation setting different from the normal operation setting. That is, the setting of the black developing voltage set as described above is applicable to both of during the operation in the black mode and during the operation in the full-color mode. In this case, similarly as described above with reference to (a) and (b) of FIG. 12, it is possible to cause the controller 50 to change the black developing voltage during the operation in the full-color mode. Or, the controller 50 may also be caused to change, as the black density setting, the black developing voltage applied in common during both of the operation in the black mode and the operation in the full-color mode.

That is, in this embodiment, the image forming apparatus 100 may also include another designating means as described below. Another designating means causes the controller 50 to change the setting of the developing voltage applied to the developing member 41*d* in the operation in the first mode relative to the setting of the developing voltage applied to other developing members 41*a*-41*c* corresponding to other image bearing members 1*a*-1*c* in the operation in the first mode. In this embodiment, similarly as in the designating means, another designating means is constituted by the operation display portion 17, the communication I/F portion 80 through which the designation from the external device 200 is inputted to the controller 50, and the like. In the case where the designation by another designating means is made, when the image is formed by the operation in the first mode, the controller 50 changes the setting of the developing voltage applied to the predetermined developing member 41*d* relative to the setting of the developing voltage applied to other developing members 41*a*-41*c*.

By employing such a constitution, also the density (or the width) of the black character image and the black line image during the operation in the full-color mode can be adjusted depending on the demand of the user or the like. Accordingly, also during the operation in the full-color mode, irrespective of the information on the image attribute such as the object data, it is possible to obtain the density (or the width) of a stable character image or a stable line image (particularly the thin line) corresponding to the selection of the operator. In order to realize such a constitution, the developing voltage source E2*d* for black may only be required to be provided independently of the voltage sources for other colors used during the operation in the full-color mode. Accordingly, for example, as shown in (b) of FIG. 13, commonality of a developing voltage source E2CL for at least two colors of yellow, magenta and cyan (in the figure, all of yellow, magenta and cyan) may also be realized.

Embodiment 2

Then, another embodiment of the present invention will be described. A basic constitution and an operation of an image forming apparatus in this embodiment are the same as those in Embodiment 1. Accordingly, in the image forming apparatus in this embodiment, elements having the same or corresponding functions and constitutions as those in Embodiment 1 are represented by the same reference numerals or symbols and will be omitted from description.

In this embodiment, as shown in (c) of FIG. 13, the developing voltage is applied from a common (the same) developing voltage source E2 to the developing rollers 41*a*-41*d* of all of the image forming portions Pa-Pd. Also in this case, similarly as in Embodiment 1, the setting of the black developing voltage during the operation in the black mode can be arbitrarily changed to setting other than the normal operation setting.

However, during the operation in the full-color mode, only the setting of the black developing voltage cannot be arbitrarily changed to setting other than the normal operation setting. This is because the developing voltage source for black and the developing voltage sources for other colors used in the operation in the full-color mode (in this embodiment, the developing voltage sources for all of the colors) are used in common, and therefore the setting of the black developing voltage has an influence on other colors.

Accordingly, in this embodiment, the setting of the black developing voltage applied from the common developing voltage source E2 to the developing roller 41*d* for black can be changed to the setting other than the normal operation setting only during the operation in the black mode. Further, during the operation in the full-color mode, the common developing voltage source E2 is constituted so as to output the developing voltage in setting (normal operation setting) before the change. Typically, during the operation in the full-color mode, in this normal operation setting, the image is formed using all of the image forming portions Pa-Pd.

Here, the following constitution can be employed in order to enable ensuring of the density of particularly the character image or the line image (particularly the thin line) by selecting the operation setting different from the normal operation setting also during the operation in the full-color mode. That is, during the operation in the full-color mode, the black image is formed using the toners of the plurality of colors (in this embodiment, yellow, magenta and cyan) in place of the black toner. In this case, even when the normal setting developing voltage is outputted from the common developing voltage source E2, the density (or the width) of the black image during the operation in the full-color mode is easily ensured. This is because a toner amount per unit area can be increased by forming the black image with the toners of the plurality of colors. In this case, for example, in a setting screen similar to that shown in (a) of FIG. 12, the controller 50 can designate that during the operation in the full-color mode, the black image is formed with the toners of the plurality of colors. Further, it is also possible to variably set the black image density during the operation in the full-color mode. For example, the amounts per unit area of the toners of the respective colors may only be required to be changed by changing exposure amounts (laser powers or areas) by the exposure devices 3 for the respective toner images of the plurality of colors relative to the black toner image portion. In this case, in the density setting screen similar to that shown in (b) of FIG. 12, the operator can variably set the black image density during the operation in the full-color mode.

That is, in this embodiment, the image forming apparatus 100 may also include another designating means as described below. In the operation in the second mode, another designating means causes the controller 50 to cause the image forming apparatus to form the image of the color (black) of the toner image formed on the predetermined image bearing member 1*d* in the operation in the first mode by superposing the toner images formed on other image bearing members 1*a*-1*c*. In this embodiment, similarly as in Embodiment 1, another designating means is constituted by the operation display portion 17, the communication I/F portion 80 through which the designation from the external device 200 is inputted to the controller 50, and the like. In the case where the designation by another designating means is made, during the operation in the second mode, the controller 50 effects control so that the image of the color (black) of the toner image formed on the predetermined image bearing member 1*d* in the operation in the first mode is formed by superposing the toner images formed on the plurality of other image bearing members 1*a*-1*c*.

By employing such a constitution, during the operation in the black mode and during the operation in the full-color mode, irrespective of the information on the image attribute such as the object data, it is possible to obtain the density (or the width) of a stable character image or a stable line image (particularly the thin line) corresponding to the selection of the operator.

Other Embodiments

The present invention was described based on the specific embodiments mentioned above, but is not limited to the above-mentioned embodiments.

Figure 14:
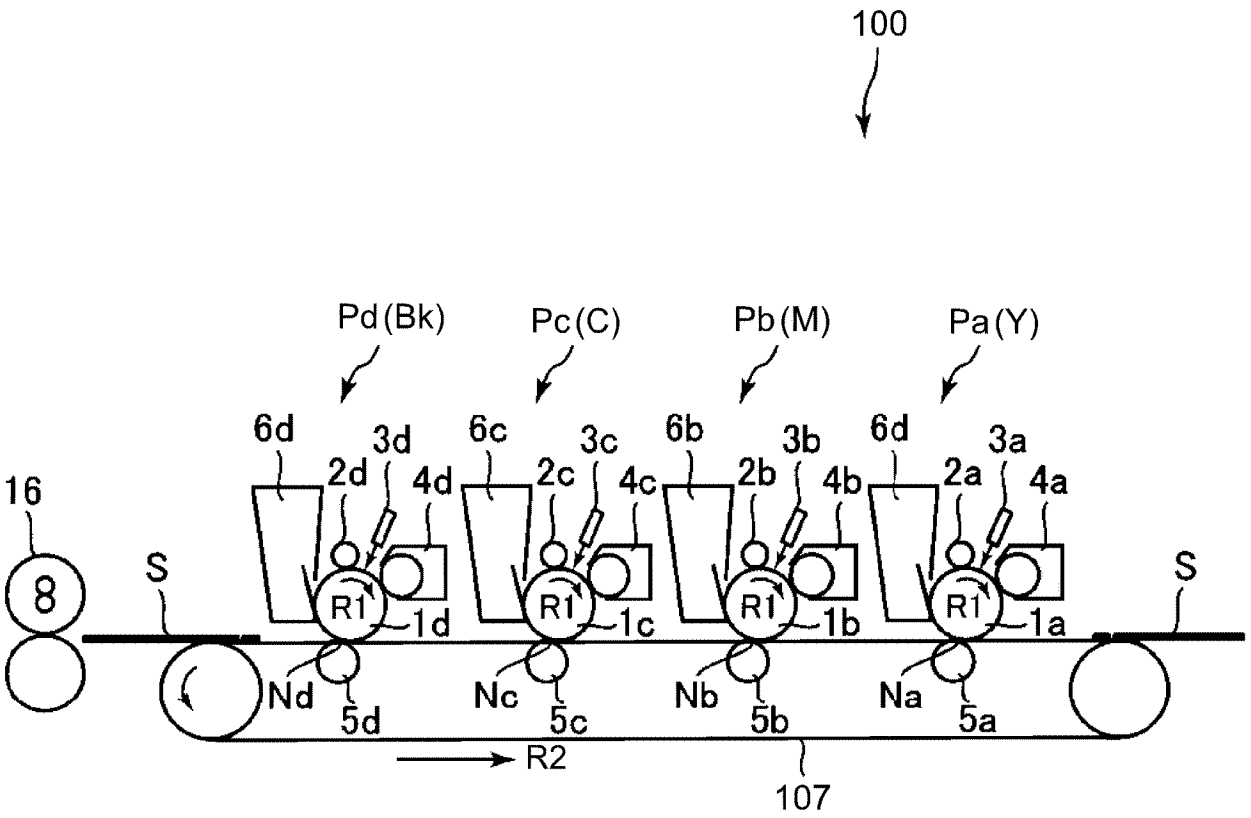
FIG. 14 is a schematic sectional view of an image forming apparatus in another embodiment.

In the above-described embodiments, the present invention was applied to the image forming apparatus of the intermediary transfer type, but is also applicable to an image forming apparatus of a direct transfer type. FIG. 14 is a schematic sectional view of a principal part of the image forming apparatus of the direct transfer type. In the image forming apparatus of FIG. 14, elements having the same or corresponding functions or constitutions as those of the image forming apparatus of FIG. 1 are represented by the same reference numerals or symbols. The image forming apparatus 100 of FIG. 14 includes an endless belt-shaped recording material carrying belt (conveying belt 107) as a recording material carrying member in place of the intermediary transfer belt 7 in the image forming apparatus of FIG. 1. The toner images formed on the photosensitive drums 1 at the respective image forming portions P are transferred at the respective transfer portions N onto the recording material S carried and conveyed by the recording material carrying belt 107. Also the image forming apparatus 100 of the direct transfer type is constituted, similarly as in the case of the image forming apparatus 100 of the intermediary transfer type, so as to be capable of forming the toner images by the operation in the full-color mode and the operation in the black mode in some instances. Accordingly, by applying the present invention to also the image forming apparatus 100 of the direct transfer type, it is possible to achieve effects similar to those of the above-described embodiments.

In the above-described embodiments, the operator such as the user arbitrarily designated that the operation setting for black is operation setting different from the normal operation setting. However, the present invention is not limited thereto. Irrespective of the designation by the operator such as the user, the operation setting for black may also be made in advance so as to be different from the normal operation setting. In this case, the designating means and another designating means are constituted by a program or the like constituted to change the setting in advance.

In the above-described embodiments, the black image was able to be reproduced so as to be not only thick (high density) but also thin (low density). However, the present invention is not limited thereto. Typically, the black image may also be adjustable only in a direction of reproducing the black image as the thick image (with the high density).

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2016-143421 filed on Jul. 21, 2016, which is hereby incorporated by reference herein in its entirety.

What is claimed is:

1. An image forming apparatus comprising:

a black image forming portion configured to form an image with a black toner, said black image forming portion including a black developing device;

a color image forming portion configured to form an image with a yellow toner, a magenta toner, and a cyan toner, said color image forming portion including a yellow developing device, a magenta developing device, and a cyan developing device;

an intermediary transfer member capable of carrying a toner image formed at said black image forming portion and a toner image formed at said color image forming portion;

a transfer portion configured to transfer the toner image from said intermediary transfer member onto a recording material; and an executing portion capable of executing an operation in a color mode in which a color image is formed on a recording material by using said color image forming portion and said black image forming portion and an operation in a monochromatic mode in which a monochromatic image is formed on a recording material by using only said black image forming portion, wherein said executing portion is capable of forming the monochromatic image in the operation in the monochromatic mode under application of a voltage to said black developing device, the voltage being applied under a voltage condition, which is inputted to said black developing device when the operation in the monochromatic mode is executed, such that a line width is broader than a line width under a voltage condition which is inputted to said black developing device when the operation in the color mode is executed, wherein a voltage in the form of an AC voltage biased with a DC voltage is applied to said black developing device, and wherein said executing portion is capable of forming the image in the operation in the monochromatic mode under application of the AC voltage to said black developing device, the AC voltage having a peak-to-peak voltage of the AC voltage which is inputted to said black developing device when the operation in the monochromatic mode is executed being greater than a peak-to-peak voltage of an AC voltage which is inputted to said black developing device when the operation in the color mode is executed.

2. The image forming apparatus according to claim 1, further comprising an operating portion configured to operate said image forming apparatus, wherein the monochromatic mode is able to be set using said operating portion.

3. The image forming apparatus according to claim 2, wherein said operating portion includes a setting portion configured to set the voltage condition which is inputted to said black developing device during the operation in the monochromatic mode.

4. The image forming apparatus according to claim 1, further comprising a common voltage source configured to apply a voltage to said black developing device, said yellow developing device, said magenta developing device, and said cyan developing device.

5. An image forming apparatus comprising:

a black image forming portion configured to form an image with a black toner, said black image forming portion including a black developing device;

a color image forming portion configured to form an image with a yellow toner, a magenta toner, and a cyan toner, said color image forming portion including a yellow developing device, a magenta developing device, and a cyan developing device;

an intermediary transfer member capable of carrying a toner image formed at said black image forming portion and a toner image formed at said color image forming portion;

a transfer portion configured to transfer the toner image from said intermediary transfer member onto a recording material; and an executing portion capable of executing an operation in a color mode in which a color image is formed on a recording material by using said color image forming portion and said black image forming portion and an operation in a monochromatic mode in which a monochromatic image is formed on a recording material by using only said black image forming portion, wherein said executing portion is capable of forming the monochromatic image in the operation in the monochromatic mode under application of a voltage to said black developing device, the voltage being applied under a voltage condition, which is inputted to said black developing deice when the operation in the monochromatic mode is executed, such that a line width is broader than a line width under a voltage condition which is inputted to said black developing device when the operation in the color mode is executed, wherein a voltage in the form of an AC voltage biased with a DC voltage is applied to said black developing device, and wherein said executing portion is capable of forming the image in the operation in the monochromatic mode under application of the AC voltage to said black developing device, the AC voltage having a frequency of the AC voltage which is inputted to said black developing device when the operation in the monochromatic mode is executed being lower than a voltage frequency of an AC voltage which is inputted to said black developing device when the operation in the color mode is executed.

6. The image forming apparatus according to claim 5, further comprising an operating portion configured to operate said image forming apparatus, wherein the monochromatic mode is able to be set using said operating portion.

7. The image forming apparatus according to claim 6, wherein said operating portion includes a setting portion configured to set the voltage condition which is inputted to said black developing device during the operation in the monochromatic mode.

8. The image forming apparatus according to claim 5, further comprising a common voltage source configured to apply a voltage to said black developing device, said yellow developing device, said magenta developing device, and said cyan developing device.

9. An image forming apparatus comprising:

a black image forming portion configured to form an image with a black toner, said black image forming portion including an image bearing member and a black developing device including a black toner;

a color image forming portion configured to form an image with a yellow toner, a magenta toner, and a cyan toner, said color image forming portion including a yellow developing device, a magenta developing device, and a cyan developing device;

an intermediary transfer member capable of carrying a toner image formed at said black image forming portion and a toner image formed at said color image forming portion;

a transfer portion configured to transfer the toner image from said intermediary transfer member onto a recording material; and an executing portion capable of executing an operation in a color mode in which a color image is formed on a recording material by using said color image forming portion and said black image forming portion and an operation in a monochromatic mode in which a monochromatic image is formed on a recording material by using only said black image forming portion, wherein said executing portion is capable of forming the monochromatic image in the operation in the monochromatic mode under application of a voltage to said black developing device, the voltage being applied under a voltage condition, which is inputted to said black developing device when the operation in the monochromatic mode is executed, such that a line width is broader than a line width under a voltage condition which is inputted to said black developing device when the operation in the color mode is executed, wherein a voltage in the form of an AC voltage biased with a DC voltage is applied to said black developing device, and wherein said executing portion is capable of forming the image in the operation in the monochromatic mode under application of the DC voltage to said black developing device, the DC voltage having an absolute value of the DC voltage which is inputted to said black developing device when the operation in the monochromatic mode is executed being higher than an absolute value of a DC voltage which is inputted to said black developing device when the operation in the color mode is executed.

10. The image forming apparatus according to claim 9, further comprising an operating portion configured to operate said image forming apparatus, wherein the monochromatic mode is able to be set using said operating portion.

11. The image forming apparatus according to claim 10, further comprising wherein said operating portion includes a setting portion configured to set the voltage condition which is inputted to said black developing device during the operation in the monochromatic mode, said setting portion being provided at said operating portion.

12. The image forming apparatus according to claim 9, further comprising a common voltage source configured to apply a voltage to said black developing device, said yellow developing device, said magenta developing device, and said cyan developing device.

* * * * *